US011858711B1

(12) United States Patent
Ibanez

(10) Patent No.: US 11,858,711 B1
(45) Date of Patent: Jan. 2, 2024

(54) HAIR DYEING SYSTEM AND METHOD

(71) Applicant: BICA Beauty LLC, New York, NY (US)

(72) Inventor: Carlos Alberto Barreto Ibanez, New York, NY (US)

(73) Assignee: BICA Beauty LLC, New York, NY (US)

( * ) Notice: Subject to any disclaimer, the term of this patent is extended or adjusted under 35 U.S.C. 154(b) by 1153 days.

(21) Appl. No.: 16/563,141

(22) Filed: Sep. 6, 2019

(51) Int. Cl.
*B65D 77/04* (2006.01)
*A45D 19/00* (2006.01)

(52) U.S. Cl.
CPC ..... *B65D 77/0413* (2013.01); *B65D 77/042* (2013.01); *A45D 19/0066* (2021.01); *A45D 2200/25* (2013.01)

(58) Field of Classification Search
CPC ..... B65D 77/0413; B65D 77/042; B65D 5/4275; B65D 5/427; B65D 77/14; B65D 1/30; B65D 33/008; A45D 19/0066; A45D 2200/25
USPC ..... 206/581
See application file for complete search history.

(56) References Cited

U.S. PATENT DOCUMENTS 2,154,085 A * 4/1939 Bergstein ..... B65D 85/328 217/23
3,294,233 A * 12/1966 Hollinger ..... B65D 77/042 206/499
3,322,323 A * 5/1967 Greene ..... B65D 5/001 229/917
3,802,555 A * 4/1974 Grasty ..... A61B 50/30 206/505
4,182,476 A * 1/1980 Lovewell ..... B65D 5/6614 229/122
4,205,776 A * 6/1980 RuWalther ..... B65D 5/427 229/120.01
5,551,454 A * 9/1996 Goncalves ..... B65D 81/3238 132/202
5,554,197 A * 9/1996 Assini ..... A61K 8/02 8/405
6,003,708 A * 12/1999 Meyering ..... B65D 1/225 220/520
D445,953 S * 7/2001 Smith ..... D28/7
6,440,175 B1 * 8/2002 Stanley, III ..... A45D 19/02 424/47
D465,612 S * 11/2002 Boyd ..... D28/20
(Continued)

*Primary Examiner* — Ernesto A Grano
(74) *Attorney, Agent, or Firm* — Pryor Cashman LLP

(57) ABSTRACT

An at-home hair dyeing system, and associated method, configured to supply a user with a customized product for a hair dyeing process, the system including an outer package and a plurality of subpackages reversibly disposed in the outer packaging, each subpackage of the plurality of subpackages being directed to a distinct step in the hair dyeing process and including one or more components associated with the distinct step, where each subpackage includes a connection mechanism for reversibly connecting to one or more adjacent subpackages, preferably by a tab and slot connection, where only one of said subpackages can be held by a unique another subpackage in order, and where a primary subpackage of the plurality of subpackages includes a developer and a colorant or a dye, the developer and the colorant or the dye being selected by or based on the preference of the user.

20 Claims, 2 Drawing Sheets

(56) References Cited

U.S. PATENT DOCUMENTS 6,835,018 B2 * 12/2004 Miczewski ..... A45D 34/04 401/196
D755,641 S * 5/2016 O'Neill ..... B65D 5/5088 D9/721
D784,807 S * 4/2017 Glass ..... D9/432
2003/0066766 A1 * 4/2003 Lechanoine ..... B65D 5/42 206/229
2004/0016064 A1 * 1/2004 Vena ..... A45D 19/026 8/406
2004/0089316 A1 * 5/2004 Hamilton ..... A61K 8/02 132/208
2004/0154108 A1 * 8/2004 Narasimhan ..... A61Q 5/12 8/405
2004/0244126 A1 * 12/2004 Vena ..... A61Q 5/10 8/406
2007/0169285 A1 * 7/2007 Narasimhan ..... A61K 8/31 8/405
2008/0178399 A1 * 7/2008 Vena ..... A61Q 5/10 8/407
2010/0206944 A1 * 8/2010 Bates ..... B65D 5/542 220/23.83
2011/0147388 A1 * 6/2011 Thomann ..... B65D 5/4275 156/291
2012/0175408 A1 * 7/2012 Wang ..... B65D 5/4275 229/115
2013/0167857 A1 * 7/2013 DeGeorge ..... A45D 7/04 206/229
2015/0360813 A1 * 12/2015 Lieber ..... B65D 5/36 220/529
2018/0037397 A1 * 2/2018 Saito ..... B65D 83/0805
2018/0168941 A1 * 6/2018 Schoepgens ..... A61K 8/42
2020/0121583 A1 * 4/2020 Russell ..... A61K 8/022
2020/0277181 A1 * 9/2020 Besen ..... A45D 44/02
2020/0279449 A1 * 9/2020 Rosenberg ..... G07F 13/06
2020/0375337 A1 * 12/2020 Tan ..... B65D 25/108
2020/0397679 A1 * 12/2020 Lev ..... A61K 8/347
2021/0403216 A1 * 12/2021 Mills ..... B65B 5/06
2022/0062122 A1 * 3/2022 Martich ..... A61Q 5/065
2022/0160614 A1 * 5/2022 Wang ..... A61K 8/463
2022/0233428 A1 * 7/2022 Fukuhara ..... A61K 8/345
2022/0315262 A1 * 10/2022 Valceschini ..... B65B 59/02

* cited by examiner

HAIR DYEING SYSTEM AND METHOD

TECHNICAL FIELD

The present invention involves a system and associated method for hair dyeing, whether the hair is for the top of one's head or a man's beard. More specifically, the present invention involves a customizable hair dyeing package including multiple subpackages that lead a user easily and in a foolproof manner through the multiple steps of the hair and/or beard dyeing process.

BACKGROUND OF THE INVENTION

At-home hair dyeing solutions are often provided in a single cardboard box containing the necessary tools and/or components. These solutions may include confusing and/or unclear instructions concerning the complicated hair dyeing process. By trying to anticipate and provide hair dyeing chemicals, fixers, gloves, rinse, brushes, etc. for everyone choosing a specific color, they present very complicated instructions that are difficult to read and follow for many. Most men and/or women buy their home hair dyeing solutions and components by making a single decision—the desired color—and that leaves the hair dyeing solution producers with the necessity, until now, of providing materials and instructions for a variety of different factors for the consumers, all leading to complication of the process. Thus, these "shotgun" solutions, i.e., a selected color for all hair factors, do not provide the same level of personalization that one would receive at a salon. However, hair dyeing at a salon is expensive compared to these at-home solutions. There is a clear need in the art for a hair dyeing system capable of easy and near foolproof at-home use that is customizable and straightforward in application. Eliminating the need for complicated instructions to cover all textures, colors, size of hands, etc. for all possibly-encountered factors is an aspect of the invention, which is especially important when dealing with caustic and/or dangerous chemicals, and the use of the same where application timing is also important. The present invention solves many of the difficult issues with current hair dyeing components and packaged products.

SUMMARY OF THE INVENTION

In general, in one aspect, the invention features a hair dyeing or men's beard dyeing system configured to supply a user with a customized or individualized product for an at-home hair dyeing process, the system including an outer shipping packaging and a plurality of subpackages reversibly disposed in the outer packaging, each subpackage of the plurality of subpackages being directed to a distinct step in the hair dyeing process and including one or more components associated with the distinct step, where each subpackage includes a connection mechanism for reversibly connecting to one or more adjacent subpackages, and where a primary subpackage of the plurality of subpackages includes a developer and a colorant or a dye, the developer and the colorant or the dye being selected by or based on the user's preference. The thrust of the present invention is to make the at-home hair and/or beard dyeing process, instructions, and components individually applicable to the precise consumer, easy and substantially foolproof, and, yet, to provide a truly near-professional look, all without the worry and risk of conventional, more complicated processes for at-home use.

Implementations of the invention may include one or more of the following features. The outer packaging may be in the form of a corrugated fiberboard or cardboard typical shipping container or box. Each subpackage within the shipping box or carton may be in the form of a paperboard or carton box. Each subpackage may include simple and specific instructional text or graphics printed thereon indicating the distinct step of the overall process. Each, but generally at least one, subpackage may include a visual image on its exterior indicating a time duration associated with the distinct step, and the visual image may include a simple digital or analog clock (indicating a number of minutes) graphically showing the duration for the application of that step(s). The connection mechanism between adjacent subpackages may be a tab of a first subpackage which slides into and is secured into the slot of the adjacent or next step subpackage.

Each slot and tab are located on each step subpackage such that the steps, defined by the subpackages, can only be packaged with the correct sequence of steps to be followed. Stated differently, the location of the slots and tabs of the subpackages are such (in one or two dimensions) that step one cannot be adjacently secured in the overall master package (the outer packaging) to step three or four, but rather its tab can only be secured to the slot of subpackage two, as the alignment/location of slot and tabs is unique between each adjacent subpackage and its next adjacent subpackage. The tab of step one's package precisely slides into the slot of step two while step two's tab (on the side of the subpackage opposed to its slot) precisely slides into and is received in the slot of step three's package. The location of the slots and tabs are precisely arranged to ensure that the steps are adjacent to one another in the desired order of use. This ensures a substantially foolproof manner of packing the master container and in use of the contents of the subpackages. The primary subpackage may further include one or more of a tray and a spatula to facilitate the on-site making of a principal component of the hair dye.

An additional subpackage of the plurality of subpackages may include one or more of a patch test, a barrier cream, and at least one pair of sized gloves. An additional subpackage of the plurality of subpackages may include one or more of a dye brush and a dye-holding tray. An additional subpackage of the plurality of subpackages may include one or more of a conditioner, a shampoo, a cleaning wipe, and a recycling kit. The plurality of subpackages may be a total of four or more subpackages. An additional subpackage of the plurality of subpackages may include a bleaching kit. An additional subpackage of the plurality of subpackages may include multiple pairs of gloves for use in multiple hair dyeing applications or a single pair of gloves uniquely matched in size to the hand size of the consumer. A subpackage can contain a rinse or "clear" liquid for application after the dyeing process.

The developer and the colorant or the dye may be selected by or based on the user's preference via an online assessment, such as via an interactive website. The developer and the colorant or the dye may be selected by or based on the user via an online or telephonic consultation. The developer and the colorant or the dye may be selected by or based on the user via an online color simulator utilizing one or more images of a model or the user him or herself as provided to the website via a camera and/or a mobile phone camera. After selection(s) are made of hair color dye sought, texture of hair, quantity or amount of hair to be dyed (streak, full head, long below the shoulder's hair, beard, etc.) age of user, size of hands, etc., the supplier/manufacturer will "pull" the appropriate components from its warehouse and assemble the individual components into the subpackages and then connect and dispose the subpackages into the master package (the outer packaging) for delivery. It is a preferred embodiment of the present invention for the master package with its home-based set of dye components to be mailed, shipped, or otherwise delivered to the consumer.

In general, in another aspect, the invention features a hair or beard dyeing method utilizing a user-customized product, the method including providing a user with a hair dyeing kit based on user selections, requirements, and/or preferences, and performing a plurality of steps associated with a plurality of subpackages provided by the hair dyeing kit in a hair dyeing process, where the hair dyeing kit includes an outer shipping and holding packaging and the plurality of subpackages contained therein reversibly disposed in the outer packaging, each subpackage of the plurality of subpackages being directed to a distinct sequential step in the hair dyeing process and including one or more components associated with the distinct step, where each subpackage includes a connection mechanism for reversibly connecting to one or more adjacent and sequential following subpackages, and in the precise desired order of intended use of the subpackages and where a primary subpackage of the plurality of subpackages includes a developer and a colorant or a dye, the developer and the colorant or the dye being selected by or based on the user's indicated preference.

Furthermore, it is an important aspect of the present invention that the individual subpackages are provided with very simple and direct text, graphics and sequential numbering to aid the user in the simple, efficient and near foolproof manner of application. In a preferred embodiment of the present invention, one or more of the subpackages are provided with a digital or analog graphic of a clock to show the amount of time for the dye and developer application. This, too, takes the worry out of the system of dyeing and again tends to make the process foolproof. The subpackages are preferably labelled with Arabic numbering to show to the user the steps for application, one step at a time, sequentially.

BRIEF DESCRIPTION OF THE DRAWING

FIG. 1 illustrates a hair dyeing system according to one and the currently preferred embodiment of the present invention and FIG. 2 illustrates a hair or beard dyeing system according to one of the embodiments wherein the tab of a first box slides into an aligned slot of its adjacent step box and its tab then slides into the slot of the next box, and so on.

DETAILED DESCRIPTION OF THE PREFERRED EMBODIMENTS AND THE DRAWINGS

The present invention is directed to a customizable hair and/or beard dyeing package and set of instructions for a single consumer including multiple subpackages that lead a user through multiple steps of an individual's hair and/or beard dyeing process.

Figure 1:
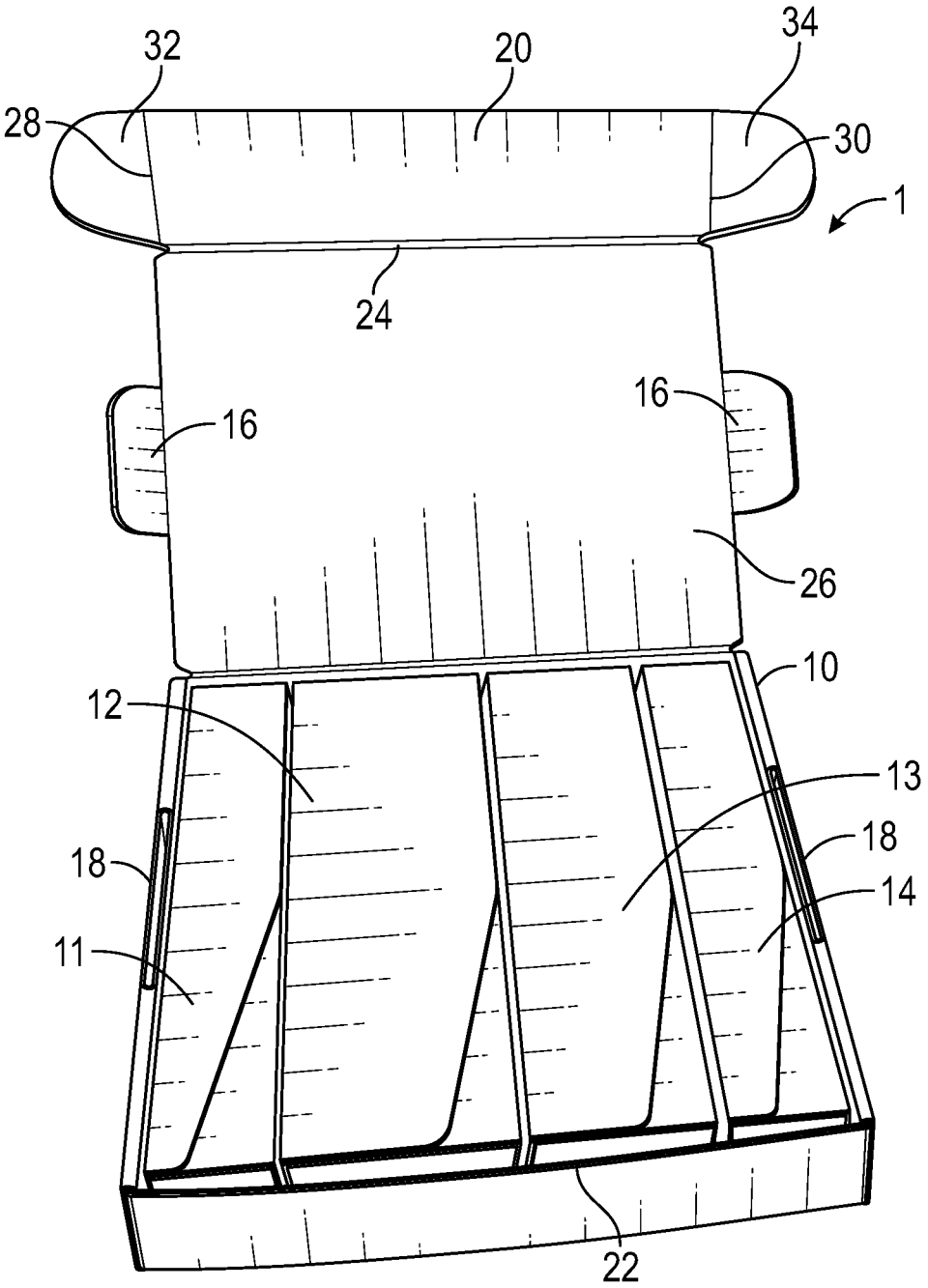

FIG. 1 shows a hair dyeing system according to one embodiment of the present invention. Hair dyeing kit 1 includes an outer or master shipping and subpackage-containing package 10 and several subpackages, specifically subpackages 11, 12, 13, and 14. In this embodiment, there are four subpackages for the total of four hair and/or beard dyeing process steps; however, the present invention is not so limited and may include more or less subpackages and/or more or less hair or beard dyeing process steps. Outer package 10 may be any acceptable packaging capable of securely holding the subpackages therein and preferably capable of being shipped via UPS®, FedEx®, DHL® and/or ordinary US Postal Service mail delivery without damage to the contents. On the other hand, the package 10 can be assembled, created and picked up at a drug store, a hair salon, a dedicated home grooming store, etc. For example, outer packaging 10 may be a corrugated fiberboard or cardboard box, sturdy enough for shipping and transport and, yet, lightweight to maintain the cost of shipment low while ensuring the materials are protected prior to use.

The package 10 includes a top, bottom, four side walls, and the top is provided with a closing set of flaps. Two side flaps 16 fit into side wall slots 18 made in the double thick sides of the holding compartment 22. The front flap 20 has a fold line 24 which separates the top 26 from the front flap 20. Fold lines 28 and 30 describe two ear flaps 32 and 34 which fold into slots in the front of the holding compartment, to seal the same, in a conventional manner with the front flap 20 held against the front side wall. Other packages or master packages can be constructed and made, as desired.

Subpackages 11-14 may be any acceptable packaging capable of holding appropriate hair dyeing process tools and/or components. For example, subpackages 11-14 may be thinner paperboard or carton boxes. Subpackages 11-14 preferably include visible writings, text, graphics and/or numerical markings printed thereon to indicate the contents of the step within the subpackage and that steps sequential position in the hair dyeing process, e.g., Box 1 and/or "Prepare," Box 2 and/or "Mix," Box 3 and/or "Apply," Box 4 and/or "Rinse" or "Clear," etc. This visual and simple labeling assists the user in correctly adhering to the necessary order of the hair dyeing process steps.

Figure 2:
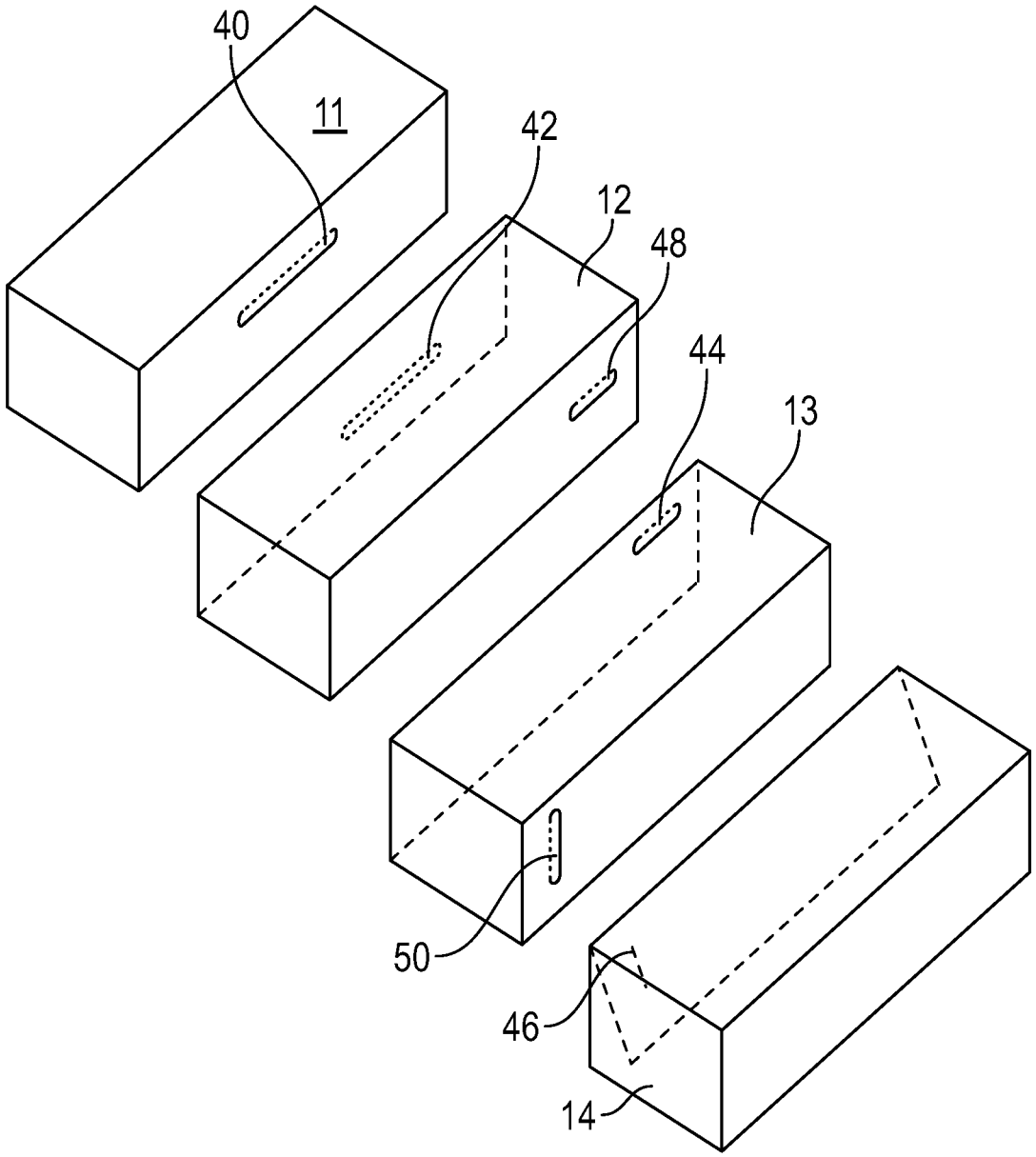

Moreover, subpackages 11-14 (See FIG. 2) preferably include a slot-tab mechanism on side wall portions of the subpackages such that adjacent subpackages may be reversibly but uniquely connected to one another in the right sequence. An outwardly extending tab 40 die cut of Box 1 (subpackage 11) will uniquely fit into a die cut slot 42 of the adjacent and opposed side wall of Box 2 (subpackage 12). The tab and the slot are of the same size in length, height and location along the opposed side walls. And that tab 40 is aligned and sized uniquely with the die cut slot 42 of Box 2 and not with the corresponding die cut slots 44 and 46 of Boxes 3 or 4, respectively. Rather, Box 1's (subpackage 11) tab 40 fits into Box 2's (subpackage 12) slot 42, Box 2's tab 48 fits into only Box 3's (subpackage 13) slot 44 and Box 3's (subpackage 13) outwardly extending tab 50 fits uniquely into Box 4's (subpackage's 13) slot 46. Each tab and its opposed corresponding slot in the adjacent subpackage are unique in length, height and location so that each box or subpackage can only be connected to the proper sequentially next box or subpackage. This connection mechanism also assists the user in correctly adhering to the necessary step order by preventing the incorrect subpackage to be removed out of turn. Additionally, subpackages 11-14 may also include visible writings or markings printed thereon to indicate the amount of time, in minutes usually, required by the hair dyeing process step. For example, the marking may be a clock image indicating 5 minutes required by the step "Apply." The clock or number of minutes can be in text, number only (same or a different color from the Box #or Direction) or can be an analog clock face with the minute hand showing the number of minutes in comparison to the hour hand pointing towards the "12" o'clock position or the clock can be a digital clock.

In the embodiment of FIG. 1, subpackage 11 is directed to a first, preparation step. Subpackage 11 may include components for a small sample patch test, a barrier cream for the hair dyeing process, and a pair of sized, protective and disposable gloves. The patch test may be any industry-accepted means of testing for a user's allergic reaction to hair dyeing process materials, including dye and developer. The test can also inform the user of the end dye color so that the user can use or change out the supplied dye. The provided pair of gloves is selected based on requirements of the user, with sizes including small, medium, large, and extra-large. The consumer may indicate the desired size, such as by matching his/her hands to a set of displayed hands on a website, and the manufacturer/supplier will then provide that specific glove size into the subpackage. This, too, makes the system and dyeing method substantially foolproof.

In the embodiment of FIG. 1, subpackage 12 is directed to a second, mixing or dye preparation step. Subpackage 12 may include a developer and a dye or colorant. Both the provided developer and the dye/colorant are selected based on color desire/requirements of the user. Other factors can impact on the desired developer and dye, of course. One or both of these materials may be provided in a tube. Additionally, a mixing tray and a spatula may be provided in this subpackage and utilized for mixing the materials and then facilitating the application step.

In the embodiment of FIG. 1, subpackage 13 is directed to a third, application step. Subpackage 13 may include a brush and a tray. Subpackage 13 may also include, by graphics and/or text, customized timing and/or instructions based on the color and treatment requirements of the user. The customized timing and/or instructions may, for example, relate to the amount of gray reduction desired, partial vs. full coverage, intensity of the color dye sought, and the like. The brush may be any industry-accepted brush for applying hair and/or beard dyeing materials, including a brush having a second end serving as a comb as well. In one embodiment of the invention, the brush is also provided in the size needed and selected by the supplier based on information gleaned from the buyer's interaction with the website, i.e., in response to queries. The application subpackage is likely to bear the details, in text, graphic, clock (digital or analog), etc. for the amount of time that the dye and/or developer should be maintained on the hair of the user.

In the embodiment of FIG. 1, subpackage 14 is directed to a fourth, rinsing or "clear" step. Subpackage 14 may include a cleansing conditioner and/or shampoo, a cleaning wipe, and a recycle kit. The cleansing conditioner and/or shampoo may be selected based on requirements of the user, such as for thin hair, normal hair, Afro-textured hair, damaged hair, ultra-damaged hair, and the like. The cleaning wipe may be provided in a sachet or tube. A recycle bag or storage kit can be provided, too.

While the embodiment of FIG. 1 is primarily directed to a hair or beard color kit, the present invention is not so limited. In another embodiment, the present invention may be directed to a bleach and color kit including, e.g., Box 1 and/or Prepare, Box 2 and/or Bleach, Box 3 and/or Color, and Box 4 Clear and/or Rinse. The bleaching subpackage may include a bleach kit and customized timing and/or instructions based on requirements of the user. The customized timing and/or instructions may relate to darkness of the user's hair. The color subpackage may include the developer and the dye or colorant as well as means of application. Additional components and aspects described with respect to the embodiment of FIG. 1 may be included in this embodiment. Here, too, the boxes are sequentially connected in a unique manner such that Box 1 connects only to Box 2 (via tab and slot), Box 2 to Box 3, via tab and slot and Box 3 to Box 4, also via another tab and slot.

In another embodiment, the present invention may be directed to a beard color kit including e.g., Box 1 and/or Prepare, Box 2 and/or Mix, Box 3 and/or Apply, and Box 4 and/or Clear or Rinse. A beard color kit of the present invention may provide for multiple applications, such as four repeatable applications. The preparation subpackage may include multiple sets of gloves for the multiple applications, such as four sets of sized for the consumer gloves. The mixing subpackage may include sufficient developer and dye or colorant for the multiple applications. The brush included in the application subpackage may be selected based on requirements of the user, such as for short beards (e.g., small bristle brush), medium-length beards (e.g., medium-length bristle), and long beards (e.g., comb inclusion). The brush may be capable of being washed between usages. The rinsing subpackage may include sufficient cleansing conditioner and/or shampoo for the multiple applications. The cleansing conditioner and/or shampoo may be selected based on requirements of the user, such as energizing, sensitive, dry, and the like. Additional components and aspects described with respect to the embodiment of FIG. 1 may be included in this embodiment.

The user may provide relevant information prior to receipt of the hair dyeing system in order to customize his or her kit. For example, the user may enter information in an online assessment. The online assessment may be configured with relevant questions, the answers to which to be provided by the user bit conveyed to the manufacturer/supplier of the complete kit. The user may also provide the relevant information to a colorist via telephone call, online messaging, and the like. The user may also make the relevant selections via an online color simulator configured to utilize images of a model user or the user him or herself (uploaded from a camera, a mobile phone camera, or another means). The hair dyeing system of the present invention is preferably configured for home delivery, such as a one-time delivery or repeat delivery (e.g., subscription-based delivery).

According to one aspect of the invention, the subpackages are provided with simple closing lids which cover the cavity of the subpackages and maintain its contents during shipping. However, for ease of use and simplification, the closing lids are partially cut on a bias (see FIG. 1) so that they do not entirely extend over the top of the subpackage but, rather, each subpackage is provided with a top partial closure (with text or a number thereon) and the top lid then covers over that but in such a manner so as to reveal the text or number of that subpackage, as shown in FIG. 1. The partial cover makes opening and closing of the subpackage far easier than if the entire top of the subpackage covered the open cavity of the subpackage.

The embodiments and examples above are illustrative, and many variations can be introduced to them without departing from the spirit of the disclosure or from the scope of the invention. For example, elements and/or features of different illustrative and exemplary embodiments herein may be combined with each other and/or substituted with each other within the scope of this disclosure. Therefore, it is intended that the invention not be limited to the particular embodiments disclosed, but that the invention will include all embodiments falling within the scope of the claims. For a better understanding of the invention, its operating advantages and the specific objects attained by its uses, reference should be had to the accompanying drawings and descriptive matter, in which there is illustrated a preferred embodiment of the invention.

What is claimed is:

1. A comprehensive hair dyeing system configured to supply a user with a customized product for an at-home hair dyeing process, the system comprising:

an outer package configured for mailing or shipping; and a plurality of subpackages reversibly disposed in the outer package, each subpackage of the plurality of subpackages being individually directed to a distinct step in the hair dyeing process and including one or more components associated with the distinct step;

wherein each subpackage includes a connection mechanism for reversibly and uniquely connecting to one or more adjacent subpackages, the connection mechanism being a slot-tab mechanism disposed on one or more corner edges or side portions of each subpackage;

wherein an alignment or a location of each slot-tab mechanism is unique between each subpackage and an adjacent subpackage within the plurality of subpackages;

wherein a primary subpackage of the plurality of subpackages includes a developer and a colorant or a dye, the developer and the colorant or the dye being selected by or based on a preference of the user; and wherein the plurality of subpackages is at least three subpackages.

2. The hair dyeing system of claim 1, wherein the outer package is in the form of a die-cut and corrugated fiberboard or cardboard box.

3. The hair dyeing system of claim 1, wherein each subpackage is in the form of a die-cut paperboard or carton box.

4. The hair dyeing system of claim 1, wherein each subpackage includes text and/or graphics printed thereon indicating the distinct step and/or the one or more components contained therein associated with the distinct step.

5. The hair dyeing system of claim 1, wherein each subpackage includes a visual time-based image indicating a duration associated with recommended application of the distinct step.

6. The hair dyeing system of claim 5, wherein the visual time-based image includes an analog or digital clock indicating the minutes of duration for that step.

7. The hair dyeing system of claim 1, wherein the primary subpackage further includes one or more of a mixing tray and a spatula.

8. The hair dyeing system of claim 1, wherein an additional subpackage of the plurality of subpackages includes one or more of a patch test, a barrier cream, and at least one pair of gloves.

9. The hair dyeing system of claim 1, wherein an additional subpackage of the plurality of subpackages includes one or more of a dye application brush and a tray.

10. The hair dyeing system of claim 1, wherein an additional subpackage of the plurality of subpackages includes one or more of a conditioner, a shampoo, a cleaning wipe, and a recycling kit.

11. The hair dyeing system of claim 1, wherein the plurality of subpackages consists of a total of four graphically, numbered, and/or textually sequenced subpackages.

12. The hair dyeing system of claim 1, wherein an additional subpackage of the plurality of subpackages includes a bleaching kit.

13. The hair dyeing system of claim 1, wherein an additional subpackage of the plurality of subpackages includes multiple pairs of same-sized gloves for use in multiple hair dyeing applications.

14. The hair dyeing system of claim 1, wherein the developer and the colorant or the dye are selected by or based on the preference of the user obtained via an online query or series of queries.

15. The hair dyeing system of claim 1, wherein the developer and the colorant or the dye are selected by or based on the preference of the user via an online or telephonic consultation.

16. The hair dyeing system of claim 1, wherein the developer and the colorant or the dye are selected by or based on the preference of the user via an online color simulator utilizing one or more images of a model or the user.

17. An at-home hair dyeing method utilizing a consumer user-customized product, the method comprising:

providing a user with a hair dyeing kit based on user selections, requirements, and/or preferences; and performing a plurality of steps associated with a plurality of subpackages provided by the hair dyeing kit in a hair dyeing process;

wherein the hair dyeing kit comprises:

an outer package configured for mailing or shipping; and the plurality of subpackages reversibly disposed in the outer package, each subpackage of the plurality of subpackages being individually directed to a distinct step in the hair dyeing process and including one or more components associated with the distinct step;

wherein each subpackage includes a connection mechanism for reversibly and uniquely connecting to one or more adjacent subpackages, the connection mechanism being a slot-tab mechanism disposed on one or more corner edges or side portions of each subpackage;

wherein an alignment or a location of each slot-tab mechanism is unique between each subpackage and an adjacent subpackage within the plurality of subpackages;

wherein a primary subpackage of the plurality of subpackages includes a developer and a colorant or a dye, the developer and the colorant or the dye being selected by or based on a preference of the user; and wherein the plurality of subpackages is at least three subpackages.

18. The at-home hair dyeing method of claim 17, wherein the outer package is in the form of a die-cut and corrugated fiberboard or cardboard box.

19. The at-home hair dyeing method of claim 17, wherein each subpackage is in the form of a die-cut paperboard or carton box.

20. The at-home hair dyeing method of claim 17, wherein the plurality of subpackages consists of a total of four graphically, numbered, and/or textually sequenced subpackages.

* * * * *